US005802904A

United States Patent [19]

Minnerop et al.

[11] Patent Number: 5,802,904

[45] **Date of Patent: *Sep. 8, 1998**

[54] MULTIPART ROLL STAND

[75] Inventors: Michael Minnerop, Düsseldorf; Manfred Albedyhl, Mettmann; Karl Otto Schmidt; Hermann Bahr, both of Hilchenbach; Egon Foermer, Meerbusch; Berthold Schulze, Wenden; Alexander Svagr, Wegberg, all of Germany

[73] Assignee: SMS Schloemann-Siemag Aktiengessellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 531,040

[22] Filed: Sep. 20, 1995

[30] Foreign Application Priority Data

Sep. 23, 1994 [DE] Germany ..... 9415429 U

[51] Int. Cl.[6] ..... B21B 13/10; B21B 31/00; B21B 31/07

[52] U.S. Cl. ..... 72/225; 72/237

[58] Field of Search ..... 72/224, 225, 237, 72/238, 245, 239, 246, 247

[56] References Cited

U.S. PATENT DOCUMENTS

| | | | |
|---|---|---|---|
| 3,948,072 | 4/1976 | Aramaki | 72/225 |
| 4,557,130 | 12/1985 | Bond | 72/225 |
| 4,932,233 | 6/1990 | Bogendorfer | 72/225 |
| 5,327,761 | 7/1994 | Piasecki et al. | 72/225 |

FOREIGN PATENT DOCUMENTS

| | | | |
|---|---|---|---|
| 2506449 | 8/1975 | Germany | 72/225 |
| 2103976 | 3/1983 | United Kingdom . | |

*Primary Examiner*—Joseph J. Hail, III
*Assistant Examiner*—Rodney Butler
*Attorney, Agent, or Firm*—Friedrich Kueffner

[57] ABSTRACT

A universal roll stand includes two vertical housings each being composed of a single piece, upper and lower transverse girders arranged above and below the vertical housings and lateral support projections for receiving vertical rolls. Tie rods are guided by the vertical housings and the transverse girders. Crossheads are insertable into recesses of the lateral support projections. A rigid universal stand is formed by connecting and screwing together the two vertical housings through the crossheads and the upper and lower transverse girders with the tie rods.

1 Claim, 6 Drawing Sheets

MULTIPART ROLL STAND

BACKGROUND OF THE INVENTION

1. Field of the Invention

The present invention relates to a multipart roll stand whose housings can be connected to one another by tie rods or the like.

2. Description of the Related Art

Various different embodiments of multipart roll stands for sets of rolls whose roll axes extend parallel to one another are known in the art.

It has also already been suggested in DE-OS 27 03 252, to put together machine frames by combining prismatic bodies whose wall surfaces extend at a right angle to each other and then to screw these bodies together.

A special type of roll stand, namely, the universal roll stands which have sets of rolls whose roll axes extend vertically and parallel to each other in addition to sets of rolls whose roll axes extend horizontally and parallel to one another, have in the past always been cast in one piece; this is the case because the sets of rolls with vertically extending roll axes must be supported by outwardly cantilevering support projections laterally of the vertical housings.

This embodiment of the universal roll stands not only requires a complicated casting procedure with frequently occurring casting defects; in addition, in these universal roll stands, the cast piece itself also requires complicated finishing, because the cast piece must be frequently rechucked for producing the necessary bores and finishing the guide surfaces. Moreover, several guide surfaces are not easily accessible for processing and require the use of complicated devises. Particularly in the case of large and heavy stands, this type of universal roll stands has the disadvantage that the transport of roll stands from the place of manufacture to the place of use is cumbersome.

SUMMARY OF THE INVENTION

Therefore, it is the primary object of the present invention to reduce the high technical requirements of manufacturing the stands and also to simplify the possibility of transporting these stands.

In accordance with the present invention, for forming a universal roll stand, the vertical housing is composed of a pair of independent side pieces which can be connected at the top and at the bottom by transverse girders with the use of tie rods. Each side piece has horizontal, lateral support projections with support pieces, wherein the support pieces are provided with recesses, and wherein independent cross-heads can be inserted in the recesses.

The configuration according to the present invention makes it possible to cast, finish and also transport the two side pieces of the stand independently of each other in the form of relatively flat bodies. The same is true for the transverse girders and the crossheads.

In accordance with another feature of the present invention, the side pieces forming the vertical housing can also be composed of two independent side piece halves which are symmetrical with respect to a vertical axis of symmetry, wherein the side piece halves can be connected by means of shrink rings placed on projections or means of tie rods. This configuration simplifies casting, finishing and the transport of the individual components.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
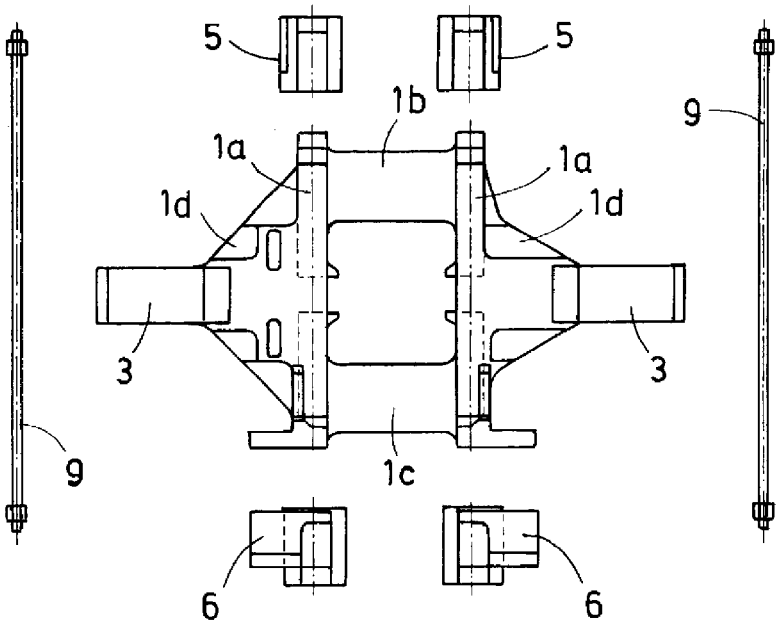
FIG. 1 is an exploded view of the components of the universal roll stand seen in the direction of rolling.
Figure 3:
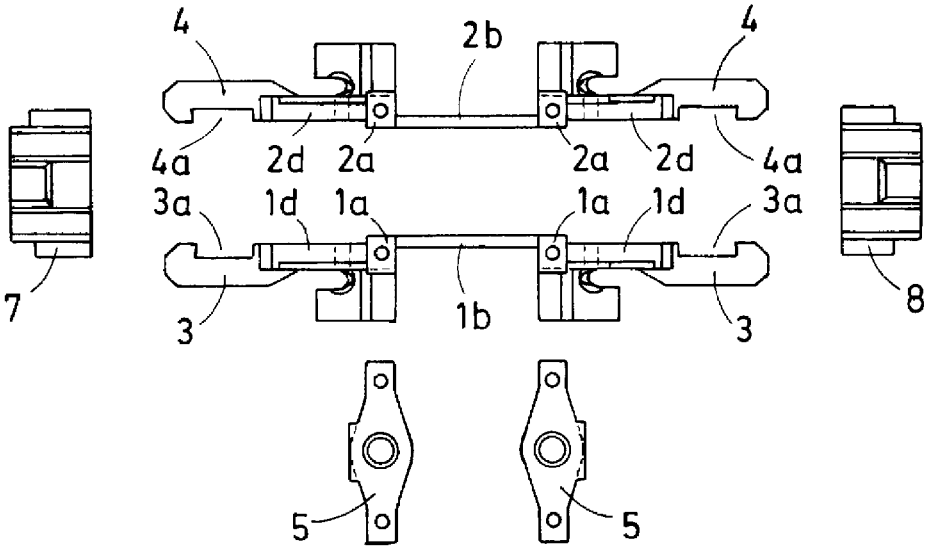
FIG. 3 is a side view of the universal roll stand of FIG. 1.
Figure 2:
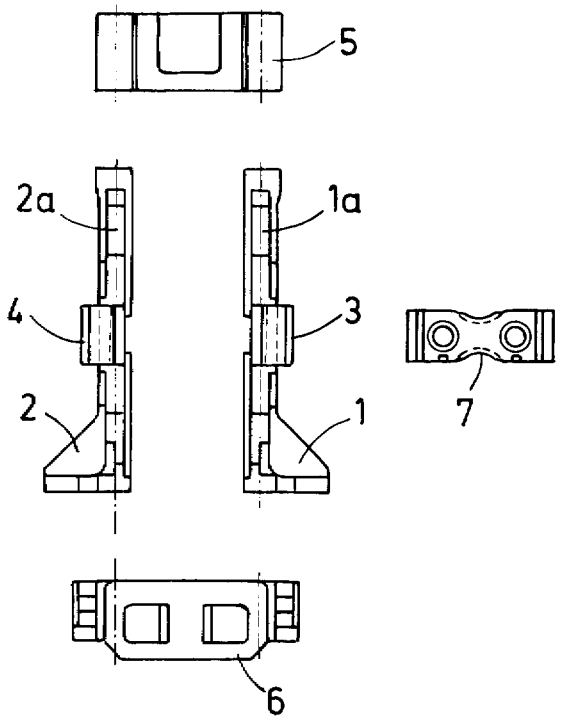
FIG. 2 is a top view of the universal roll stand of FIG. 1.

As illustrated in FIGS. 1–3 of the drawing, the vertical housing of the universal roll stand includes two side pieces 1 and 2 which are each composed of housing posts 1*a* or 2*a*, respectively, connected by upper and lower cross beams 1*b* or 1*c*, respectively. Support projections 1*d* and 2*d* project laterally outwardly from these housing posts 1*a* and 2*a*. Bearing chocks, not shown, of the vertical rolls are later supported and guided in these support projections 1*d* and 2*d*. At the ends of these support projections 1*d* and 2*d* are provided support members 3 and 4, respectively, which are guided in longitudinal directions in the support projections. The support members 3 and 4 have dovetail-shaped recesses 3*a* and 4*a*, respectively. The vertical housings further include pairs of upper and lower transverse girders 5 and 6, respectively, and a pair of crossheads 7 and 8, respectively, which can be inserted into the dovetail-shaped recesses 3*a*, 4*a* of the support members 3, 4.

Figure 4:
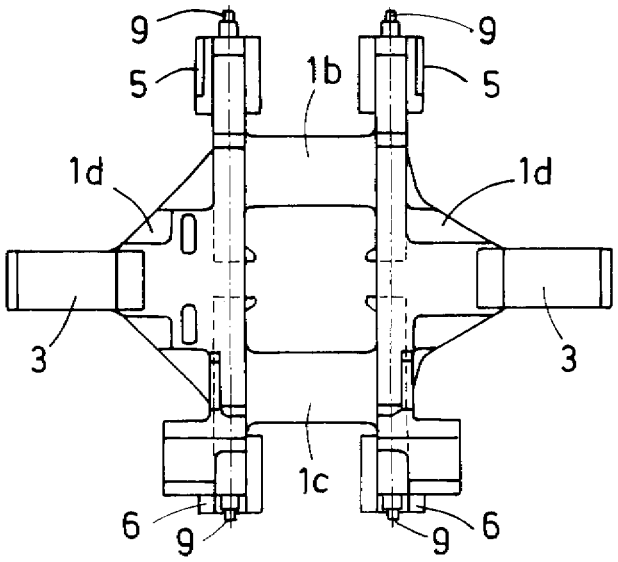
FIGS. 4–6 are views corresponding to FIGS. 1–3 showing the assembled universal roll stand.
Figure 5:
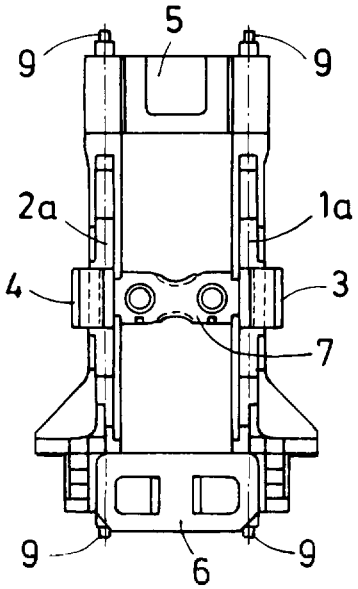
Figure 6:
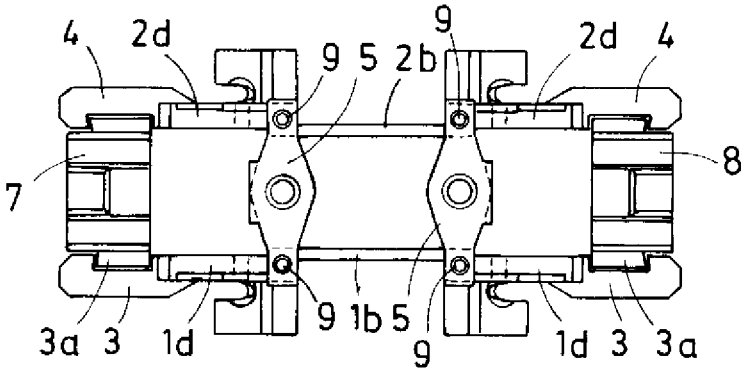
Figure 7:
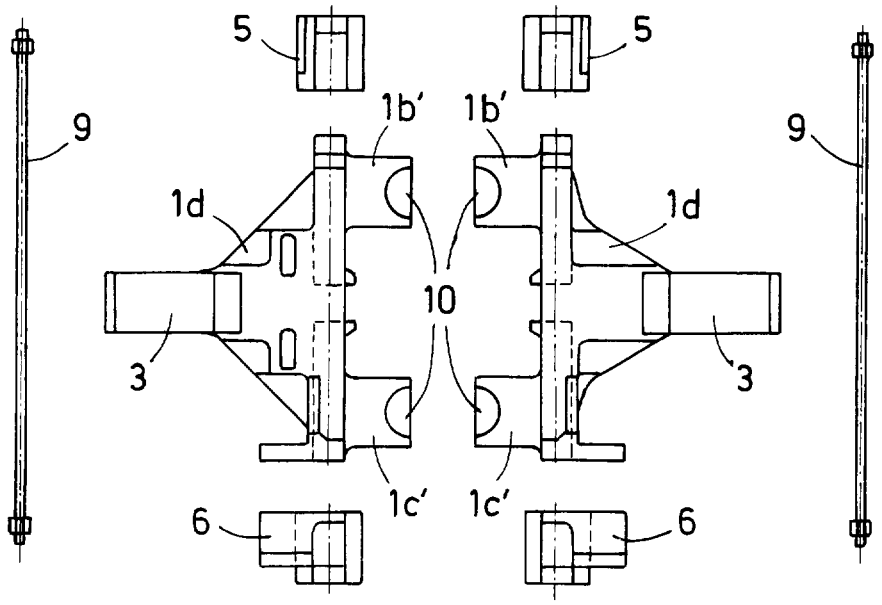
FIG. 7 is an exploded view showing the components of another embodiment of the universal roll stand according to the present invention.
Figure 9:
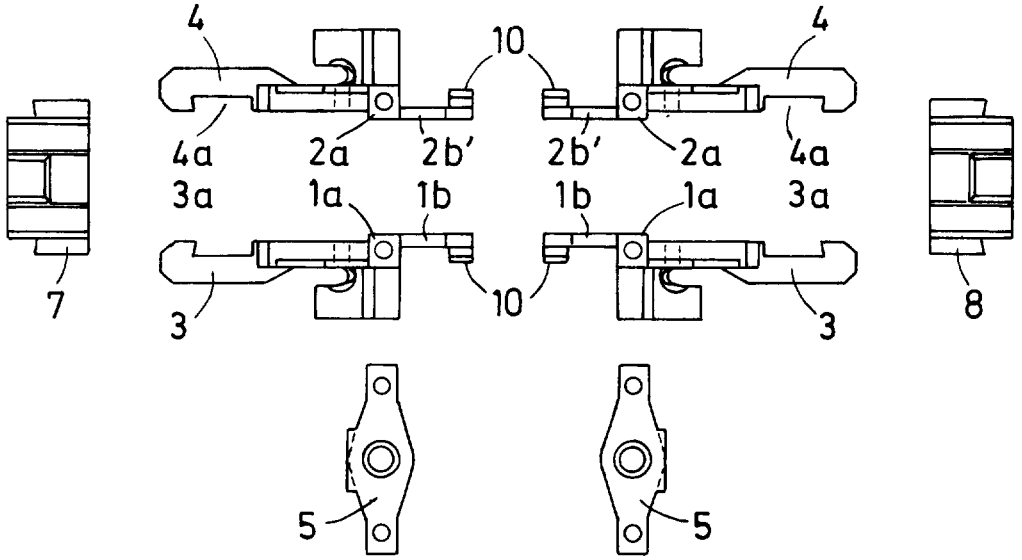
FIG. 9 is a side view of the universal roll stand of FIG. 7.
Figure 8:
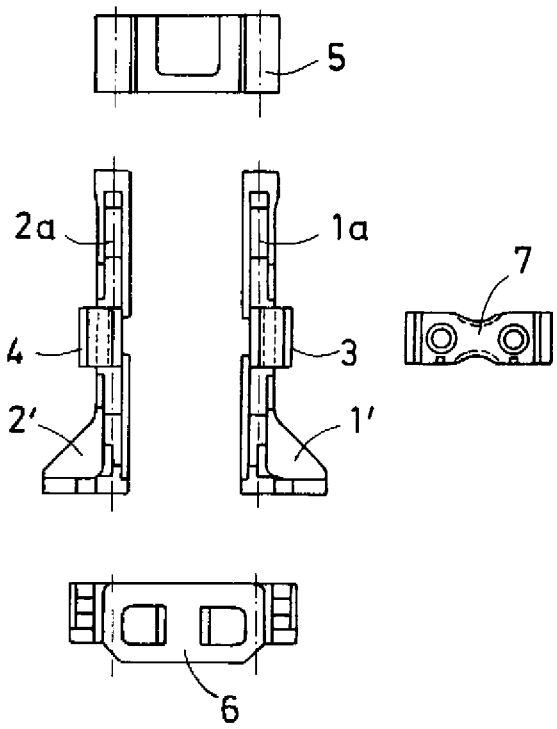
FIG. 8 is a top view of the universal roll stand of FIG. 7.

As illustrated in FIGS. 4–6, the vertical housing is obtained by connecting the side pieces 1 and 2 to one another through the upper transverse girders 5 and 6 by means of the tie rods 9 which extend through the transverse girders 5 and the housing posts 1*a*, 2*a*. The vertical housing is completed in order to form the universal roll stand by subsequently inserting the crossheads 7 and 8 into the recesses 3*a*, 4*a* of the support members 3, 4 of the support projections 1*d*, 2*d*, respectively.

Figure 10:
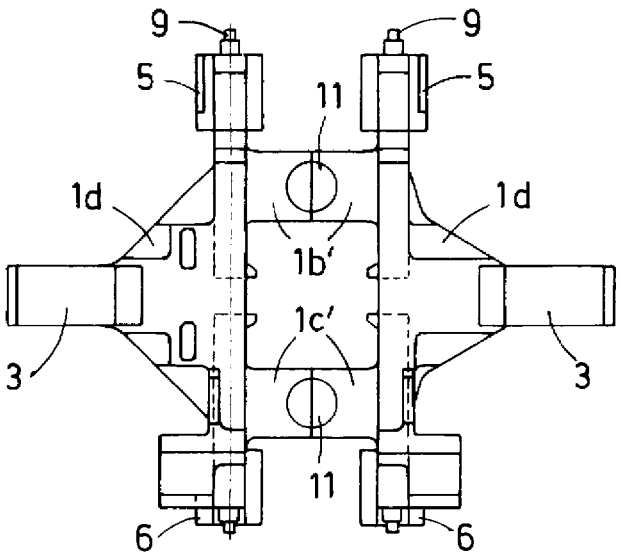
FIGS. 10–12 are views corresponding to FIGS. 7–9 showing the assembled universal roll stand.
Figure 11:
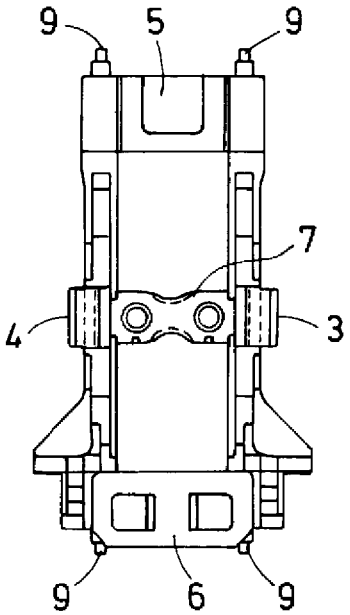
Figure 12:
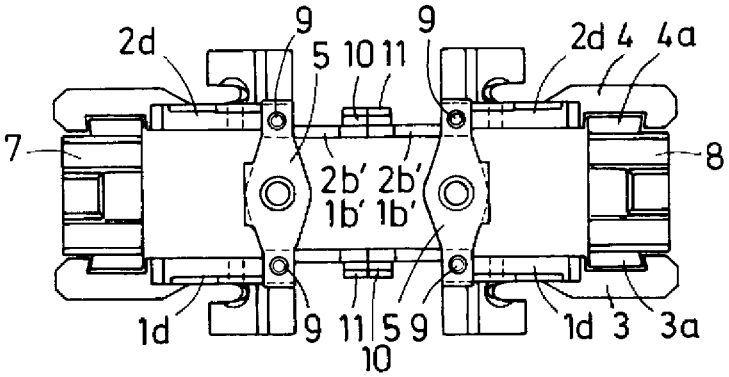

The configuration of the universal roll stand according to FIGS. 7–9 and 10–12 corresponds essentially to that of the universal roll stand of FIGS. 1–6. An additional feature of the universal roll stand if FIGS. 7–12 is the fact that the two side pieces 1' and 2' are divided into two equal halves which are obtained by vertically dividing the upper and lower crossbeams 1*b*', 1*c*' and 2*b*', 2*c*', respectively, in the middle thereof. In the middle where the crossbeams are divided, they have projections 10 which, as illustrated in FIGS. 10 and 12, are connected to one another by means of shrink rings 11.

While specific embodiments of the invention have been shown and described in detail to illustrate the inventive principles, it will be understood that the invention may be embodied otherwise without departing from such principles.

We claim:

1. In a universal roll stand including two pairs of vertical housings, wherein the housings of each pair are connected to one another by upper and lower crossbeams, wherein the housings have at sides thereof facing away from the crossbeams lateral support projections for receiving vertical rolls, and wherein the pairs of vertical housings are connected to one another by transverse girders, the improvement comprising the vertical housings of each pair of vertical housings being composed of a single piece with the crossbeams and the lateral support projections, tie rods guided by the vertical housings and the transverse girders, wherein the pairs of vertical housings are connected to each other horizontally and vertically by the tie rods and by crossheads inserted in recesses of the lateral support projections to form the universal roll stand.

* * * * *